US012715083B2

(12) United States Patent
Eaves

(10) Patent No.: US 12,715,083 B2
(45) Date of Patent: Aug. 25, 2026

(54) SYSTEMS AND METHODS FOR DISPENSING SOLID AND LIQUID MATERIALS

(71) Applicant: Michael Scott Eaves, San Diego, CA (US)

(72) Inventor: Michael Scott Eaves, San Diego, CA (US)

( * ) Notice: Subject to any disclaimer, the term of this patent is extended or adjusted under 35 U.S.C. 154(b) by 649 days.

(21) Appl. No.: 17/383,681

(22) Filed: Jul. 23, 2021

(65) Prior Publication Data

US 2023/0025768 A1 Jan. 26, 2023

(51) Int. Cl.
*A47L 13/17* (2006.01)
*A45D 34/04* (2006.01)
(Continued)

(52) U.S. Cl.
CPC ..... *B24D 99/00* (2013.01); *A45D 34/04* (2013.01); *A45D 40/06* (2013.01);
(Continued)

(58) Field of Classification Search
CPC ..... A46B 11/0041; A46B 11/0065; A46B 11/0072; A46B 11/0075; A46B 11/0086; A46B 2200/3033; A46B 2200/3086; A46B 2200/3093; B65D 47/42; B65D 83/0094; A47K 7/03; A47L 13/17; A47L 13/28; A47L 17/08; A47L 21/04; A47L 13/286;
(Continued)

(56) References Cited

U.S. PATENT DOCUMENTS 1,524,008 A 1/1925 Samuel
2,911,757 A 11/1959 Ciancel
(Continued)

FOREIGN PATENT DOCUMENTS

CN 210931072 U 7/2020 ..... A47K 5/02
GB 165348 A 6/1921
(Continued)

OTHER PUBLICATIONS

International Search Report and Written Opinion dated Dec. 19, 2022 in related International Application PCT/US22/038089 filed Jul. 22, 2022 (10 pages).
(Continued)

*Primary Examiner* — Brian D Keller
*Assistant Examiner* — Alberto Saenz
(74) *Attorney, Agent, or Firm* — Dentons US LLP

(57) ABSTRACT

Applicator devices and methods for dispensing solid and liquid materials therefrom are disclosed. The applicator devices provide for application of a wide variety of liquid and solid materials from a hand-held device in combination with a buffing element. The devices generally include a top portion that forms a housing and a bottom portion that defines a buffing element. The top portion incudes an interior side that defines an inner cavity configured to contain the liquid or solid material and an exterior side having at least a portion configured to be grasped by a user's hand. Attachment between the housing and the buffing element may be releasable so that various interchangeable buffing elements may be used in combination with the liquid or solid material contained in the housing of the device.

16 Claims, 12 Drawing Sheets

(51) Int. Cl.

| | |
|---|---|
| ***A45D 40/06*** | (2006.01) |
| ***A46B 11/00*** | (2006.01) |
| ***A47L 13/286*** | (2006.01) |
| ***A47L 17/08*** | (2006.01) |
| ***A47L 21/04*** | (2006.01) |
| ***B24D 15/04*** | (2006.01) |
| ***B24D 99/00*** | (2010.01) |
| *A45D 34/00* | (2006.01) |
| *A47K 7/03* | (2006.01) |

(52) U.S. Cl.
CPC ..... *A46B 11/0041* (2013.01); *A46B 11/0065* (2013.01); *A46B 11/0075* (2013.01); *A46B 11/0086* (2013.01); *A47L 13/17* (2013.01); *A47L 13/286* (2013.01); *A47L 17/08* (2013.01); *A47L 21/04* (2013.01); *B24D 15/04* (2013.01); *A45D 2034/005* (2013.01); *A46B 2200/3033* (2013.01); *A46B 2200/3086* (2013.01); *A46B 2200/3093* (2013.01); *A47K 7/03* (2013.01)

(58) Field of Classification Search
CPC ..... B24D 99/00; B24D 15/04; A45D 34/04; A45D 40/06
USPC ..... 451/442; 401/183, 184, 185, 186, 205, 401/206, 265, 266, 270, 278
See application file for complete search history.

(56) References Cited

U.S. PATENT DOCUMENTS

| | | | | | |
|---|---|---|---|---|---|
| 2,963,728 | A * | 12/1960 | Michaely | A47L 13/22 | 401/270 |
| 3,256,894 | A * | 6/1966 | Sherman | A46B 11/0055 | 401/176 |
| 4,775,256 | A | 10/1988 | Roth | | |
| 5,003,659 | A * | 4/1991 | Paepke | A47L 17/08 | 15/244.1 |
| 6,210,064 | B1 * | 4/2001 | White | A46B 11/0062 | 401/279 |
| 6,241,412 | B1 * | 6/2001 | Spies | A46B 11/002 | 222/105 |
| 9,877,618 | B2 | 1/2018 | Kemp | A47K 7/03 | |
| 9,877,619 | B1 | 1/2018 | Diaz | A47K 7/03 | |
| 9,918,593 | B2 | 3/2018 | Leblanc et al. | 401/201 | |
| 2005/0199651 | A1 | 9/2005 | Laflamme | | |
| 2008/0205963 | A1 | 8/2008 | Schmidig | 401/6 | |
| 2009/0263176 | A1 * | 10/2009 | Mileti | A46B 11/0065 | 401/184 |
| 2013/0058698 | A1 * | 3/2013 | Hasidashvili | A47K 7/03 | 401/6 |
| 2016/0029770 | A1 * | 2/2016 | Megaro | B05C 17/0217 | 222/1 |
| 2019/0105688 | A1 * | 4/2019 | Bourne | B08B 3/04 | |
| 2020/0305654 | A1 * | 10/2020 | Eivaz | A46B 11/0062 | |

FOREIGN PATENT DOCUMENTS

| | | | | |
|---|---|---|---|---|
| GB | 2359253 | A | 8/2001 | A47K 5/02 |
| JP | 2004305789 | A | 11/2004 | A47K 5/03 |
| WO | WO200633093 | A1 | 3/2006 | B43K 5/00 |
| WO | WO201577852 | A1 | 6/2015 | A47K 5/122 |

OTHER PUBLICATIONS

Loofah sponge with soap dispenser, downloaded from internet Aug. 10, 2020, http://designportfolios.philau.edu/gallery/35069369/Loofah-with-Soap-Dispenser (3 pages).
Refillable soap dispensing loofah, downloaded from internet Aug. 10, 2020, https://www.thisiswhyimbroke.com/uk/refillable-soap-dispensing-loofah/ (20 pages).
Save every bit of bar soap with this clever sponge soap dish, downloaded from internet Aug. 10, 2020, https://www.buzzfeed.com/carolineemiller/save-every-bit-of-bar-soap-with-this-clever-sponge-soap-dish (15 pages).
Sponge Soap, Limnos Sponge Co., downloaded from internet Aug. 10, 2020, https://limnos.com/product/sponge-soap/ (2 pages).

* cited by examiner

SYSTEMS AND METHODS FOR DISPENSING SOLID AND LIQUID MATERIALS

TECHNICAL FIELD OF THE INVENTION

The embodiments relate generally to systems and methods for dispensing a liquid or solid material, such as a soap, lotion, medicament, glue, degreaser, and the like, in combination with a buffing material.

BACKGROUND OF THE INVENTION

The use of buffing or abrasive materials such as sponges for cleaning the body or other surfaces is known, as is use of such materials in combination with liquid and solid soaps for cleaning. Typically, a user applies a quantity of the liquid or solid soap to the sponge for cleaning or buffing and, after a short use duration, must reapply the soap.

Devices that combine a reservoir for liquid soap with the abrasive material alleviate the issues of reapplying the soap. Such a combination is described in International Publication No. WO 2006/033093, which describes a sponge having a liquid soap reservoir positioned therein. Each of U.S. Pat. Nos. 8,002,486, 9,877,618, 9,877,619, and 9,918,593; US Pat. Application Pub. 2020/0305654; and International Publication No. WO 2015/077852 describes a top cap portion having a reservoir configured to be filled with a liquid soap and a bottom scrubber portion comprising a scrubber element. Soap may be ejected from the reservoirs of these various combinations into the scrubber or sponge element by squeezing the reservoir, depressing a button, or turning a dial. In each case, however, the reservoirs are not configured for use with a solid soap, and do not offer the opportunity for use with disposable reservoirs.

US Pat. Application Pub. 2013/0058698 describes a device having a sponge on a bottom surface and a reservoir attached thereon. The reservoir is configured to hold a container for a liquid, wherein turning a dial on the reservoir compresses the container and forces the liquid from valves positioned on the container. Thus, while it is mentioned that the container may be exchanged, the integral nature of the valves on the container affords a system that is expensive and/or may not be leak proof.

Devices that combine a solid soap with an abrasive material are also known, such as the combinations disclosed in U.S. Pat. No. 1,524,008, Chinese Pat. No. 210931072U, and U.K. Pat. Application No. GB2359253. Each describe a sponge holder that includes a pocket configured to contain a solid soap so that one face of the soap is exposed. As the soap is used, however, the ability of the sponge material to contain the soap is likely diminished. U.K. Pat. Application No. GB165348 describes a sponge material having an internal pocket that completely encases the solid soap, and thus would not suffer this problem. This solution, however, was intended as a means to store the solid soap and is not configured to provide use of the sponge when the soap is encased therein.

Accordingly, a need exists for improved systems and methods of dispensing a solid or liquid material directly to, and in combination with use of, a buffing or abrasive material for application to a surface.

SUMMARY OF THE INVENTION

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

The presently disclosure provides an applicator device for dispensing a liquid or solid material. The device may generally comprise a housing having an interior side that defines an inner cavity configured to contain the liquid or solid material, an exterior side, wherein at least a portion of which is configured as a grip, and a circumferential edge. Removeably attachable to the housing, such as at or adjacent the circumferential edge, is an interchangeable buffing element. Exemplary attachment means for the buffing element to the device include any one or more of a magnet, hook and loop closure, latch, or snap-type fastener, such as a shoulder bevel that engages a ledge or groove on the housing. The liquid or solid material may be dispensed from the housing to the buffing element when in use.

Exemplary buffing elements comprise a textile, a sponge-like material such as a sponge or loofah, a brush, an abrasive material such as steel wool, rounded protrusions, or any combination thereof.

Exemplary liquid materials comprise any of soaps, medications, beauty and personal care products such as lotions, shampoos, conditioners, shave lotions, aftershaves, household cleaning products such as degreasers, dish soaps, silverware cleaners, disinfectants, deodorizers, shoeshine lotions, and the like. Exemplary solid materials comprise any of solid soaps, waxes, solid medications, solid beauty and personal care products such as deodorants, shoe shines waxes, and the like.

In one arrangement, the applicator device may be configured to contain a liquid material within an inner cavity of the housing and the device may comprise at least one self-sealing valve, wherein an applied pressure on the housing forces the liquid material from the housing to the buffing element via the at least one valve. The housing may comprise a button and/or a pliable material portion that accepts the applied pressure to force the liquid material from the housing to the buffing element via the at least one valve. The buffing element may comprise at least one liquid material port configured to allow passage of the liquid material to a bottom side of the buffing element. The buffing element may releasably snap into a groove or ledge on the circumferential edge of the housing, such as via a shoulder on the buffing element that engages a ledge or groove on the housing.

In another arrangement, the applicator device may be configured to contain the liquid material in a cartridge that may be received in the inner cavity of the housing. The cartridge may form an airtight seal with the housing when received therein such that application of a pressure on the housing, e.g., via a button and/or a pliable material portion, may force the liquid material through at least one valve positioned in the cartridge to the buffing element. The airtight seal between the cartridge and the housing may comprise a snap attachment, such as a shoulder on the buffing element that engages either of a groove or ledge on the circumferential edge of the housing.

In yet another arrangement, the applicator device may be configured to contain the liquid material in a cartridge that may be received in the inner cavity of the housing, and may include a base plate having a top side, a bottom side, and a circumferential edge substantially coincident with the circumferential edge of the housing. The bottom side of the base plate releasably attaches to the buffing element and the top side of the base plate releasably attaches to the circumferential edge of the housing. At least one valve may be positioned in the base plate, wherein the at least one valve is a self-sealing valve comprising a distal end facing the housing and configured to pierce the cartridge contained therein to provide a fluid passage for the liquid material to the buffing element. The cartridge may form an airtight seal with the housing when received in the inner cavity such that application of a pressure on the housing, e.g., via a button and/or a pliable material portion, may force the liquid material through at least one valve to the buffing element. The airtight seal between the cartridge and the housing may comprise a snap attachment in either of a groove or ledge on the circumferential edge of the housing.

In yet another arrangement, the applicator device may be configured to contain the liquid material in a cartridge that may be received in the inner cavity of the housing, and may include a base plate having a top side, a bottom side, and a circumferential edge substantially coincident with the circumferential edge of the housing. The bottom side of the base plate releasably attaches to the buffing element and the top side of the base plate releasably attaches to the circumferential edge of the housing. At least one valve may be positioned in the base plate, wherein the at least one valve is a self-sealing valve comprising a distal end facing the housing and configured to pierce the cartridge contained therein to provide a fluid passage for the liquid material to a pressure chamber, such as a pressure chamber connected to or formed as part of the base plate. Accordingly, a trigger element, such as positioned on or adjacent the buffing element, may accept the applied pressure and place a responsive pressure on the pressure chamber to force the liquid material contained therein through at least one fluid line to the buffing element. Upon release of the applied pressure on the trigger element, the pressure chamber is configured to form a vacuum that pulls the liquid material from the cartridge via the at least one valve to refill the pressure chamber. The at least one fluid line may include a self-sealing valve.

An arrangement configured to dispense a solid material may generally comprise a housing having an interior side that defines an inner receiving cavity comprising at least one groove and configured to accept the solid material. The buffing element includes a top side, a bottom side, and a central cavity configured to allow passage of the solid material, wherein the buffing element is releasably attachable to the circumferential edge of the housing. The solid material may comprise at least one tongue molded directly into the solid material at a distal end thereof, wherein the at least one tongue of the solid material and the at least one groove of the receiving cavity are engageable to provide connection therebetween. Each of the at least one tongue of the solid material and the at least one groove of the receiving cavity may comprise teeth that interact with one another when the solid material is engaged with the receiving cavity to provide movement therebetween in a single direction only. The housing may further comprise a cover having an inner portion and an outer portion, wherein one of the inner portion and the outer portion is moveably attached to the other such that movement therebetween moves the inner portion in the receiving cavity to move the solid material through the central cavity of the buffing element toward the bottom side thereof.

In another arrangement configured to dispense a solid material, the inner receiving cavity of the housing may comprise a plurality of grooves, and the solid material may be at least partially molded with a solid material cartridge at a distal end thereof, wherein the solid material cartridge comprises a plurality of tongues matched to the plurality of grooves in such an arrangement, each of the plurality of tongues and grooves comprise teeth that interact with one another when the solid material cartridge is engaged with the receiving cavity to provide movement therebetween in a single direction only.

In another arrangement configured to dispense a solid material, the applicator device may include an upper exterior surface, wherein at least a portion of the upper exterior surface is configured as a grip, an interior receiving cavity configured to accept the solid material, wherein the interior receiving cavity comprises a circumferential element configured to engage with a retention element on the solid material, and a bottom exterior surface comprising a buffing element, wherein the buffing element includes a central cavity configured to allow passage of the solid material therethrough. The grip generally comprises a handle region connected to the upper exterior surface by a neck region, wherein the neck region has an outer circumferential diameter smaller than the handle region and an inner surface that extends the interior receiving cavity and comprises the circumferential element.

BRIEF DESCRIPTION OF THE DRAWINGS

Aspects, features, benefits and advantages of the embodiments herein will be apparent with regard to the following description, appended claims, and accompanying drawings. In the following figures, like numerals represent like features in the various views. It is to be noted that features and components in these drawings, illustrating the views of embodiments of the present disclosure, unless stated to be otherwise, are not necessarily drawn to scale.

DETAILED DESCRIPTION

Figure 1:
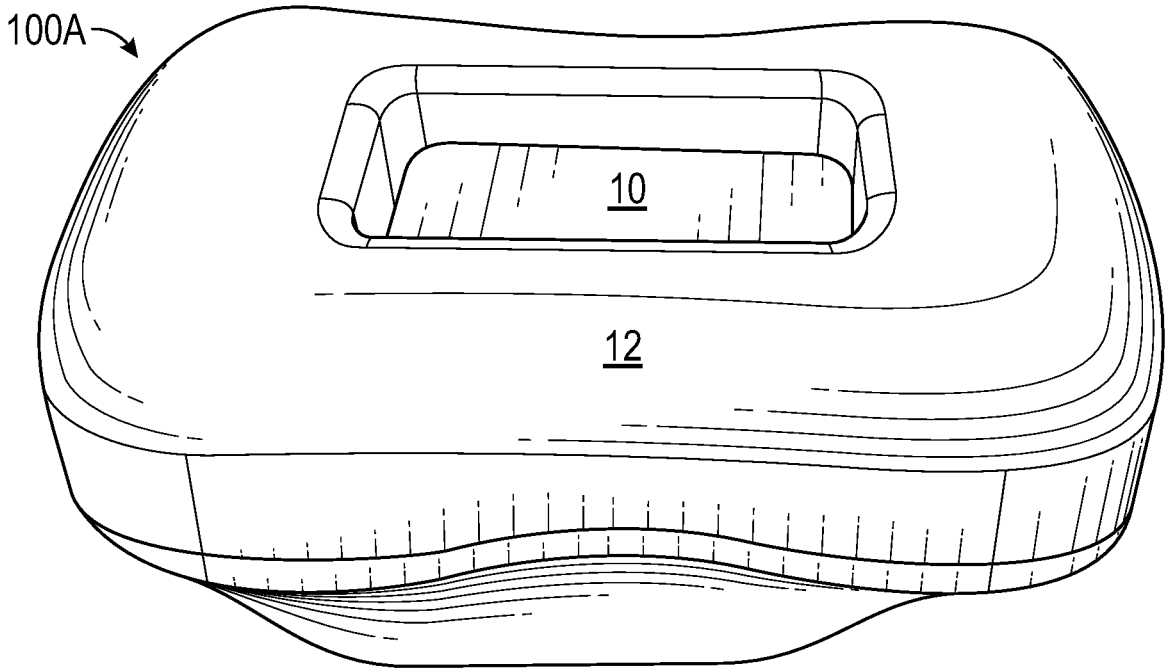
FIG. 1 illustrates a perspective view of a bottom surface of an exemplary applicator device configured for use with a solid material according to certain aspects of the presently disclosed embodiments.

In the following description, the present disclosure is set forth in the context of various alternative embodiments and implementations involving an applicator device for dispensing a solid or liquid material for use in combination with an interchangeable buffing element.

Various aspects of the device may be illustrated by describing components that are coupled, attached, and/or joined together. As used herein, the terms "coupled", "attached", and/or "joined" are interchangeably used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in said examples.

Various aspects of the system may be illustrated with reference to one or more exemplary implementations. As used herein, the term "exemplary" means "serving as an example, instance, or illustration," and should not necessarily be construed as preferred or advantageous over other variations of the devices, systems, or methods disclosed herein. "Optional" or "optionally" means that the subsequently described event or circumstance may or may not occur, and that the description includes instances where the event occurs and instances where it does not. In addition, the word "comprising" as used herein means "including, but not limited to".

Furthermore, throughout the specification, reference to "one embodiment," "an embodiment," or "some embodiments" means that a particular described feature, structure, or characteristic is included in at least one embodiment. Thus, appearances of the phrases "in one embodiment," "in an embodiment," or "in some embodiments" in various places throughout this specification are not necessarily all referring to the same embodiment. Those skilled in the art will recognize that the various embodiments can be practiced without one or more of the specific details or with other methods, components, materials, etc. In other instances, well-known structures, materials, or operations are not shown or not described in detail to avoid obscuring aspects of the embodiments.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the various parts of the needle or any assembly of them may be used.

It must also be noted that as used herein and in the appended claims, the singular forms "a", "an", and "the" include the plural reference unless the context clearly dictates otherwise. Thus, for example, reference to "a" cartridge, "an" abrasive material, or "the" groove, is a reference to one or more of each and equivalents thereof known to those skilled in the art, and so forth. Unless defined otherwise, all technical and scientific terms used herein have the same meanings as commonly understood by one of ordinary skill in the art.

The applicator devices disclosure herein offer a unique combination of elements that provide for application of a wide variety of liquid and solid materials from a hand-held device in combination with a buffing element. The devices generally comprise a top portion that forms a housing and a bottom portion that defines an interchangeable buffing element. The top portion incudes an interior side that defines an inner cavity configured to contain the liquid or solid material and an exterior side having at least a portion configured to be grasped by a user's hand. Attachment between the housing and the buffing element is releasable so that various different interchangeable buffing elements may be used in combination with the liquid or solid material contained in the housing of the device.

Exemplary attachment means for the buffing element to the device include any one or more of a magnet, hook and loop closure, latch, or snap-type fastener, such as a shoulder bevel or extension (e.g., arm) that engages a ledge or groove. When in use, the liquid or solid material may be dispensed from the housing to the buffing element.

Exemplary liquid materials that may be applied/dispensed by the applicator devices disclosed herein include any of soaps, medications, beauty and personal care products such as lotions, shampoos, conditioners, shave lotions, aftershaves, cleaning products such as degreasers, dish soaps, silverware cleaners, disinfectants, deodorizers, shoeshine lotions, and the like. Exemplary solid materials comprise any of solid soaps, waxes, solid medications, solid beauty and personal care products such as deodorants, show shine waxes, and the like. Moreover, a wide range of interchangeable buffing elements may be releasably attached to the device, such as textiles (e.g., terry cloth, chamois), sponge-like materials such as a sponge or loofah, a brush, an abrasive material such as steel wool or pumice, rounded protrusions, or any combination thereof.

The applicator device may find use in a wide range of applications, some of which are listed hereinbelow.

By way of example, the applicator device may be used for personal care routines such as dispensing soap in combination with a sponge or loofa element for bathing; dispensing shaving cream or lotion in combination with a brush element for shaving; dispensing lotions, moisturizers, aftershave, and even makeup products in combination with a soft textile, brush, or sponge; dispensing soap or lotion in combination with a pumice for cleaning a user's hands and/or feet; dispensing shampoo or conditioner in combination with a brush or massage bead surface for hair care; dispensing toothpaste in combination with a brush for brushing the user's teeth; dispensing sunscreens, bug sprays, or topical medications or antiseptics in combination with a sponge or soft textile; etc.

As additional examples, the applicator device may be used in pet care routines, such as dispensing soap, shampoo, and/or conditioner in combination with a brush or massage bead surface for washing a pet; dispensing topical medications, antiseptics, or moisturizers in combination with a brush or sponge; etc.

The applicator device may find use for household activities, such as to dispense soap in combination with steel wool to clean pots, or in combination with a sponge or brush to clean dishes or silverware; dispensing polishing agents in combination with a soft textile to polish silverware or furniture; dispensing cleaners, deodorizers, and/or protectants in combination with a soft textile to clean windows, furniture, upholstery, and the like; dispensing carpet shampoo or floor cleaner in combination with a brush to clean floor surfaces; etc.

The applicator device may find use for care of mechanical parts, such as by dispensing cleaners, degreasers, oils, or bluing useful during cleaning and/or caring for a gun, or while fixing parts on an automobile or other mechanical device. The applicator device may dispense waxes, soaps or other cleaners useful while caring for a car body, interior, and/or tires.

While specific examples are provided, any combination of liquid and/or solid material and buffing element may be provided to be applied/dispensed using the applicator devices and methods disclosed herein.

Figure 2:
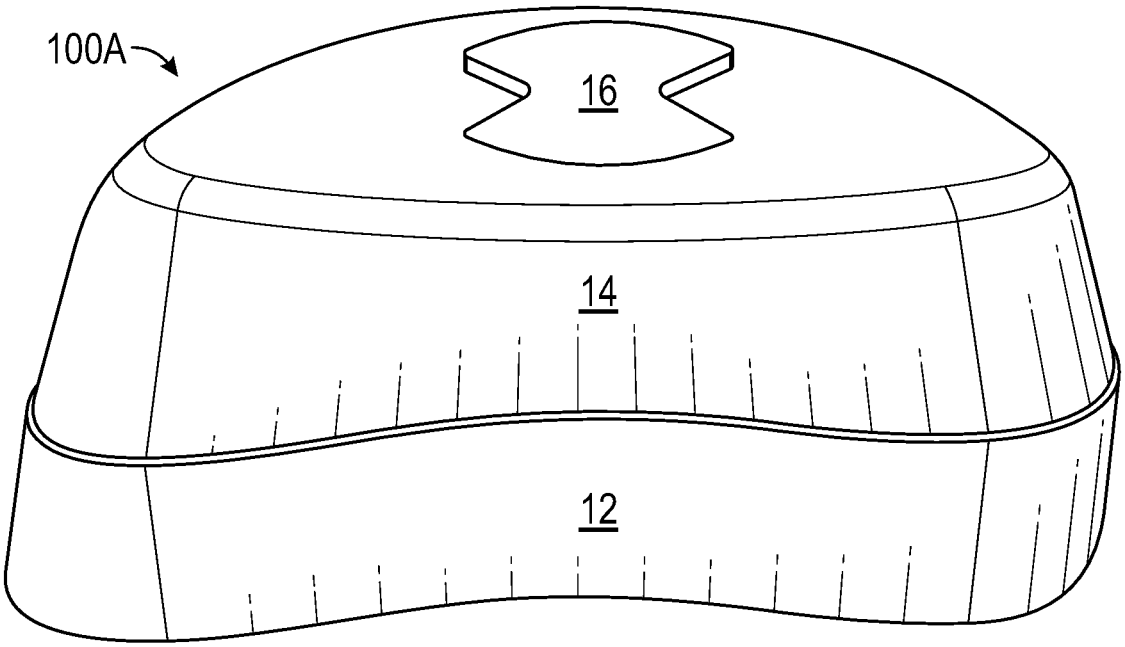
FIG. 2 illustrates a perspective view of a top surface of the applicator device shown in FIG. 1.

With reference now to the drawings in FIGS. 1-19C, specific arrangements of the applicator devices and methods of their use will be detailed. Shown in FIGS. 1-10 are applicator devices configured for containing and dispensing liquid materials and shown in FIGS. 11-19C are applicator devices configured for containing and dispensing solid materials.

with specific reference to FIGS. 1 and 2, an applicator device 100A configured to contain a solid material 10 within an inner cavity is illustrated. A bottom portion of the device includes a buffing element 12, shown in the FIGS. 1 and 2 as comprising a sponge material, while a top portion of the device comprises a housing 14. The housing 14 includes an outer profile having at least a portion thereof configured to be grasped by a user's hand, such as a handle or grip. The housing may also comprise a cover 16 that encloses the solid material, while the buffing element 12 may be open on a bottom surface thereof so that the solid material 10 is accessible for application to a surface.

Figure 3:
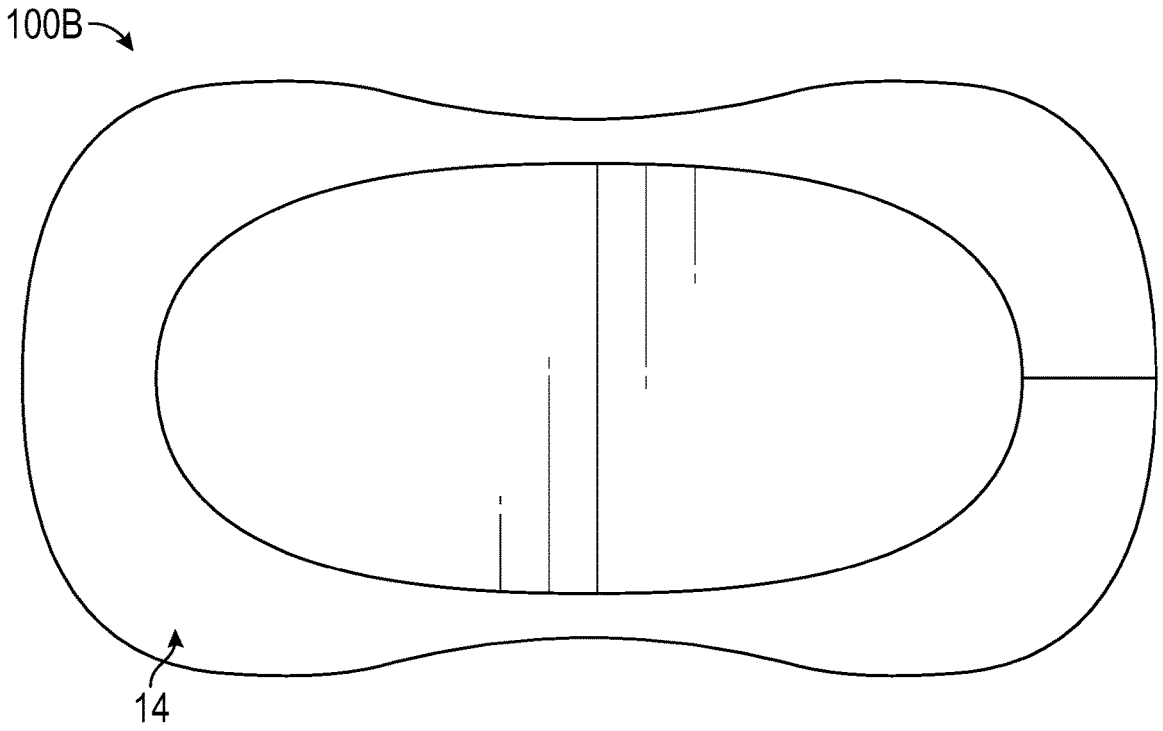
FIG. 3 illustrates a top view of an exemplary applicator device configured for use with a liquid material according to certain aspects of the presently disclosed embodiments.
Figure 4:
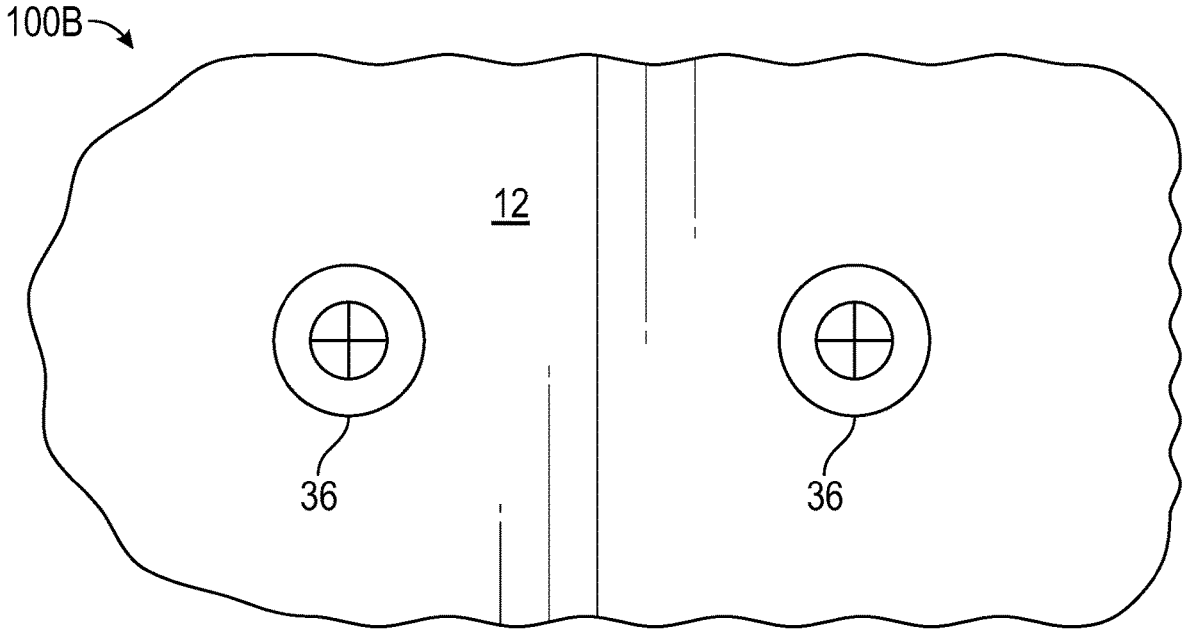
FIG. 4 illustrates a bottom view of the applicator device shown in FIG. 3.

With reference to FIGS. 3 and 4, an applicator device 100B configured to contain a liquid material is shown. The top portion of the device may be configured as a housing 14 to contain the liquid material within an inner cavity thereof. At least a portion of the housing 14 may comprise an outer profile that defines a handle or grip. The bottom portion of the device includes a buffing element 12. The liquid material is dispensed to the buffing element 12 through one or more ports 36.

Figure 5:
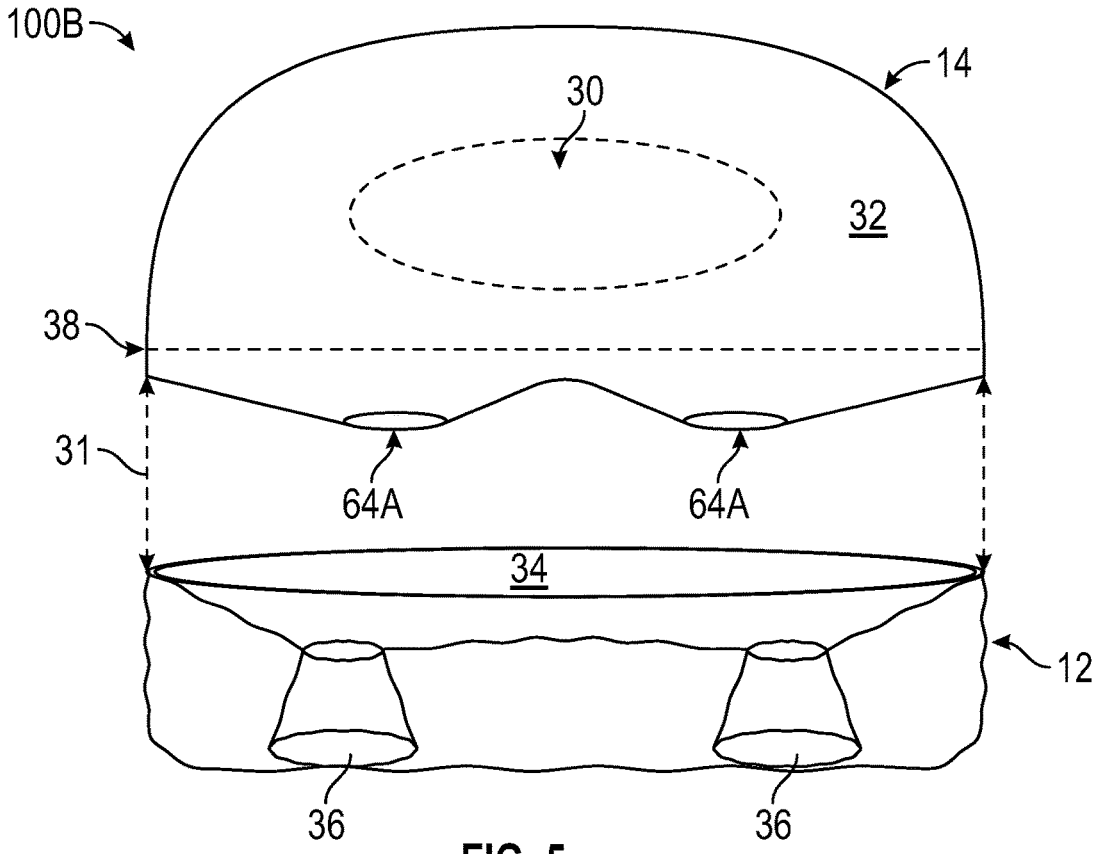
FIG. 5 illustrates a partially exploded side view of an exemplary applicator device configured for use with a liquid material according to certain aspects of the presently disclosed embodiments.

An exemplary applicator device 100B for liquid materials is shown in greater detail in FIG. 5. The housing 14 may include one or more buttons or other flexible or pliable regions (30, see also 52 of FIG. 7) on an outer surface 32 that accept an applied pressure, such as from squeezing by a user's hand, to force the liquid material from the housing 14 to the buffing element 12 via at least one opening 64*a*. The opening 64*a* may comprise a self-sealing valve that provides fluid flow in one direction only, such as from an interior of the housing 14 to the buffing element 12. Exemplary self-sealing valve includes at least slit valves, duckbill valves, umbrella valves, jet valves, and the like.

Figure 6A:
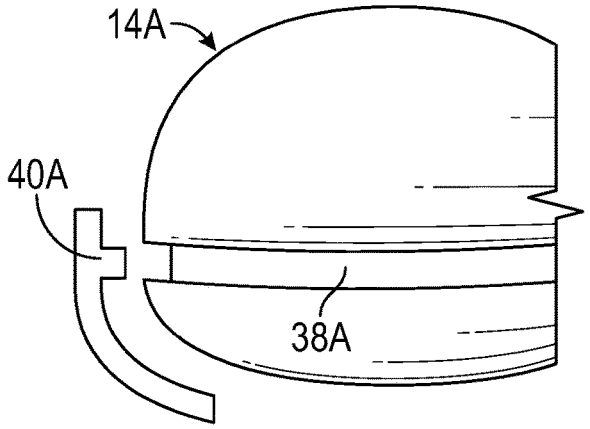
FIGS. 6A and 6B illustrate close-up views of various connection arm configurations providing connection between a base plate and a housing of an exemplary applicator device configured for use with a liquid material according to certain aspects of the presently disclosed embodiments.
Figure 6B:
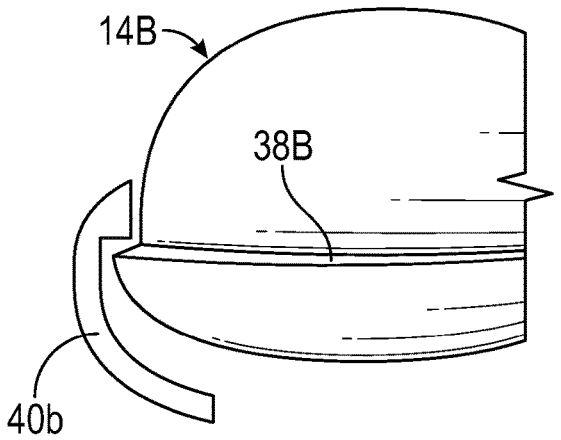

With continued reference to FIG. 5, the buffing element 12 may comprise at least one liquid material port 36 configured to allow passage of the liquid material to a bottom side of the buffing element. Connection between the buffing element 12 and the housing 14 may be along a vertical axis (arrow 31) such that a top surface 34 of the buffing element 12 contacts a bottom side of the housing 14 with the openings (64*a*) or valves aligned with the ports 36. Exemplary releasable connections are shown in FIGS. 6A and 6B. In one example, the buffing element 12 may comprise a shoulder or lip with a protrusion 40*a* that engages or snaps onto a groove 38*a* on the housing 14*a*, e.g., snap fit connection (FIG. 6A). The buffing element 12 may alternatively comprise a shoulder or lip with a bevel 40*b* that engages or snaps onto a connection lip 38*b* on the housing (14*b*; FIG. 6B).

While the releasable connection is shown in FIGS. 6A and 6B as comprising an arm having a protrusion or bevel (40*a*, 40*b*, respectively) on the buffing element 12 that engages or snaps onto a circumferential groove 38*a* or connection lip 38*b* on the housing (14*a* and 14*b*, respectively), the buffing element 12 may comprise one or more latches configured to engage the groove or ledge (i.e., one or more individual elements). Moreover, while the groove 38*a* and/or connection lip 38*b* are shown to be circumferential (38 of FIG. 5) on the housing 14, individual regions having a groove or ledge of defined size may be included on the housing. The various connection means may be included on either or both of the housing 14 and the buffing element 12, e.g., a groove or ledge may be included on the buffing element and the arms may be included on the housing, or each of the buffing element and housing may include a combination of corresponding elements. Moreover, other means of connecting the buffing element 12 to the housing 14 are possible and within the scope of the present disclosure, such as magnets, hook and loop closures, and the like.

Figure 7:
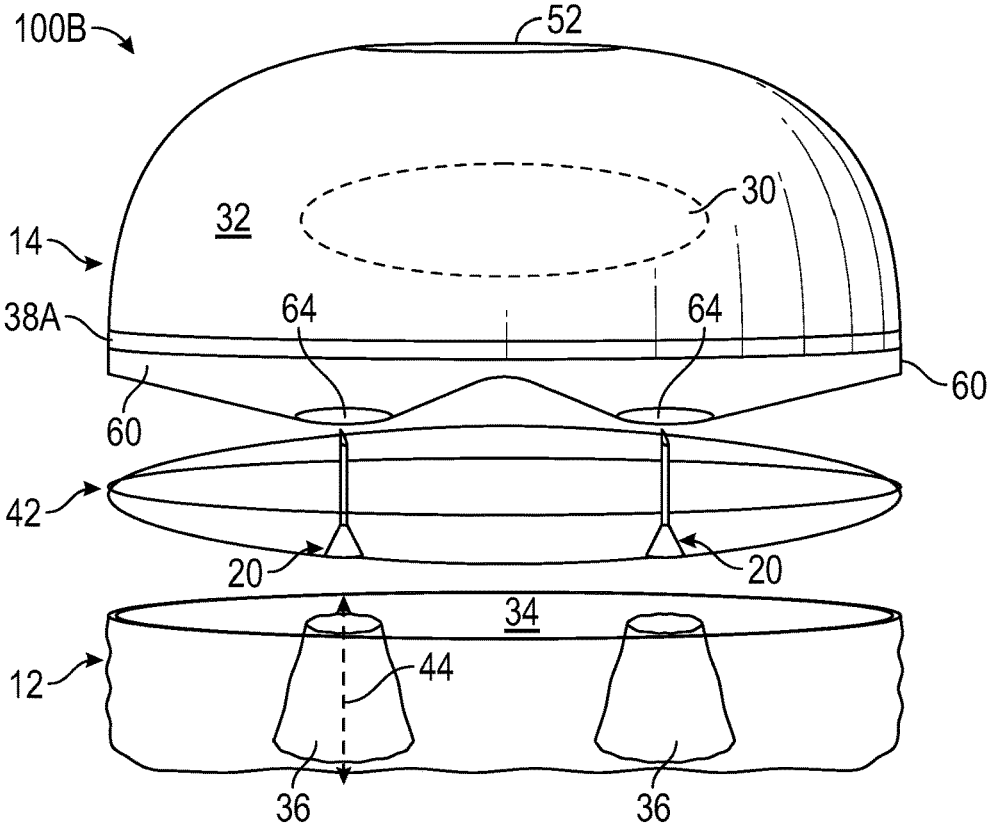
FIG. 7 illustrates a partially exploded side view of an exemplary applicator device configured for use with a liquid material according to certain aspects of the presently disclosed embodiments.

With reference to FIG. 7, the applicator device 100B may comprise a base plate 42 that provides connection between the housing 14 and the buffing element 12 and includes the self-sealing valve(s) 20. A top surface of the base plate 42 may be releasably attachable to a bottom surface of the housing 14 so that the valve(s) 20 align with openings 64 in the housing and optional ports 36 in the buffing element 12 to provide flow of the liquid material in the direction of arrow 44. In some arrangements of the applicator device 100B, the housing 14 may be configured to contain the liquid material in a liquid reservoir or cartridge 60 that may be received in the inner cavity of the housing 14.

The base plate 42 may include a shoulder or lip with a protrusion that engages or snaps onto a groove 38*a* on the housing or may comprise a shoulder or lip with a bevel that engages or snaps onto a ledge on the housing. As indicated above, various other types and configurations of releasable connectors are also possible, such as latches and/or individual regions having a groove or ledge of defined size, wherein any combination may be included on either or both of the base plate 42 and the housing 14.

Figure 8:
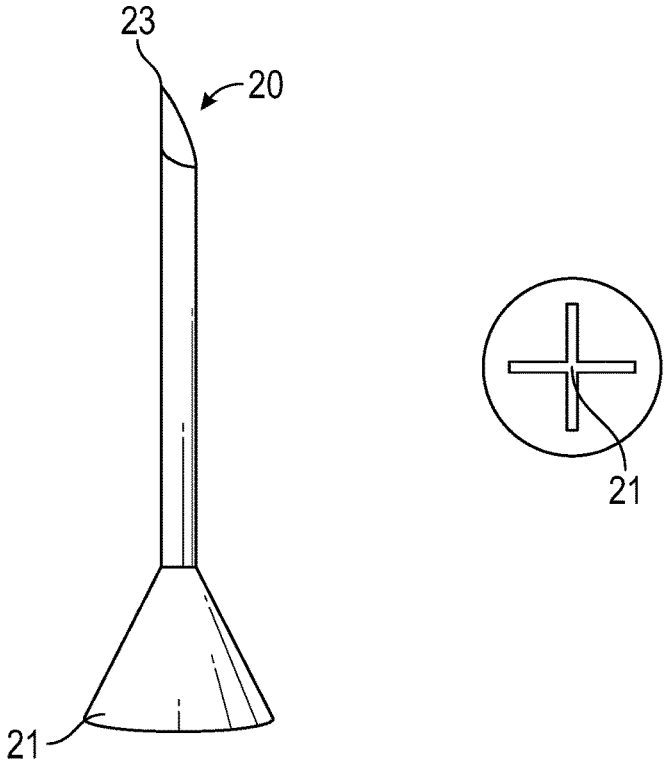
FIG. 8 illustrates side and top views of an exemplary valve for use in the applicator device of FIG. 7.

As shown in FIGS. 7 and 8, the self-sealing valve 20 may include a bottom end 21 facing the buffing element 12 that includes the self-sealing portion (e.g., jet valve, slit valve, umbrella valve, duckbill valve portion that opens to provide fluid flow under increased pressure), and a top piercing end 23 (distal end) facing the housing 14 that may puncture a region of the liquid material reservoir, such as the openings 64 on the cartridge 60 containing the liquid material or openings 64*a* of the housing 14 (as shown in FIG. 5) configured to directly contain the liquid material. The top piercing end 23 may comprise, for example, a beveled cannula. Alternatively, the top end of the self-sealing valve may not pierce the openings (64, 64*a*), but may include a push-lock style fitting or connection. In such a case, a matched fitting portion would be included on the housing 14 or cartridge 60.

A top surface 34 of the buffing element 12 may be releasably attachable to a bottom surface of the base plate 42. Exemplary releasable attachments include one or more of a magnet, hook and loop closure, latch, snap-type fastener, and the like. In a preferred configuration, the base plate 42 may include a snap fit style connection to the housing 14 and a magnetic connection to the buffing element 12. In this way, the base plate 42 may be securely but releasably connected to the housing 14 and the top piercing end 23 of the valves 20 may provide a fluid path for the liquid material from the housing 14 or the cartridge 60 contained in the housing. Various buffing elements 12 may then be attached to the device 1008 depending on the application and exchanged when a different application is desired.

As shown in FIG. 7, the base plate 42 has a circumference substantially coincident with the circumference of the housing 14, and the buffing element 12 has a circumference substantially coincident with the base plate 42. Each of the base plate 42 and/or buffing element 12 may be sized larger or smaller than the housing 14. In certain configurations, the buffing element 12 may be sized and/or shaped differently than the remainder of the applicator device to enable different functions of the device.

Figure 9:
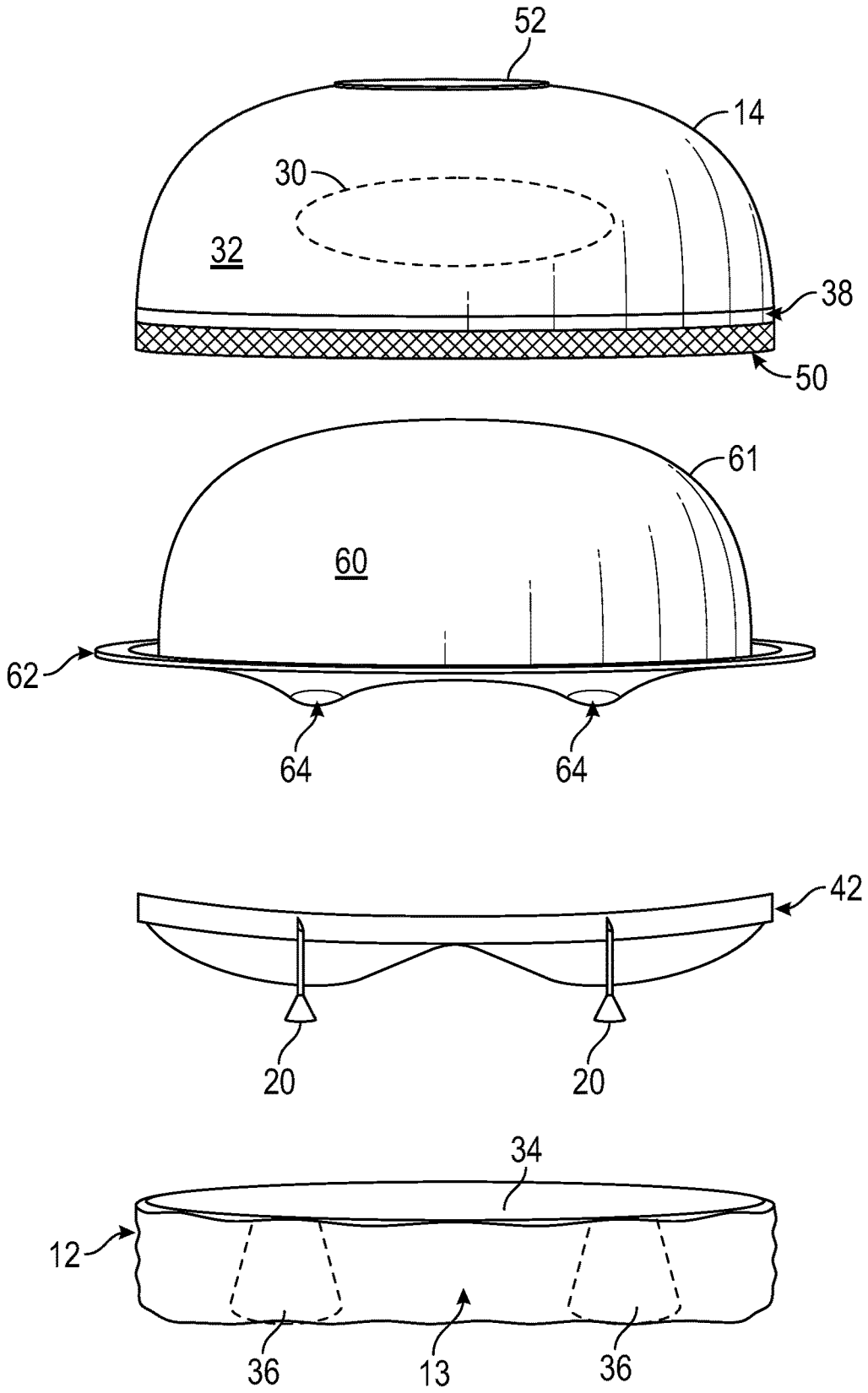
FIG. 9 illustrates a fully exploded side view of an exemplary applicator device configured for use with a liquid material according to certain aspects of the presently disclosed embodiments.

With reference to FIG. 9, a fully exploded view of the components of one exemplary configuration of the applicator device 1008 is shown. The housing 14 is shown to include buttons and/or pliable material portions or regions (30, 52) on an outer surface 32 that allow a user to apply increased pressure (e.g., depress or squeeze) to the contents of the housing, such as a liquid material contained in the housing or in a cartridge 60 contained in the housing.

An exemplary cartridge 60 configured to contain the liquid material and to fit within a cavity 50 in the housing 14 is shown. The cartridge 60 may include a circumferential edge 62 that connects with a bottom rim of the housing 14 to form an airtight seal with the housing when received therein. This may allow any pressure applied to the housing (e.g., via the buttons and/or pliable regions) to be transmitted to the contents of the cartridge 60, wherein at least a portion of which is formed of a pliable material. For example, the top portion 61 of the cartridge 60 may be formed of a flexible or pliable polymeric material, such as a thin walled plastic bag, while the rim 62 may comprise a thicker region of the same material or a different material, such as an elastomeric material that may assist in forming the air-tight seal with the housing.

The housing 14 may include a pressure relief valve, such that after squeezing the housing to force the liquid material through the self-sealing valve(s) 20, the pressure within the housing may equalize with atmospheric pressure (e.g., vacuum relief valve). In the configurations comprising a cartridge 60, the pressure relief valve may only need relieve a vacuum created in the inner cavity of the housing (relieve a gas vacuum).

With continued reference to FIG. 9, the base plate 42 is shown with the self-sealing valves positioned to pierce regions (e.g., opening 64) of the cartridge 60. These regions may include the same material as the rest of the cartridge 60 or may comprise a different material, such as an elastomeric material that may seal around the piercing end of the valve 20 after it is positioned therethrough. In some cases, should the user wish to use a different liquid material, they could simply release the connection between the base plate 42 and the housing 14 and exchange the cartridge 60. The regions pierced by the valves 20 may "heal" or close so that the liquid material contained therein may not leak from the cartridge. The user could then insert a cartridge 60 containing a different liquid material within the housing and reattach the housing to the base plate 42 and buffing element 12 to provide fluid flow through the valves 20 to the buffing element.

The releasable connection between the base plate 42 and the housing 14 may further allow different base plates 42 to be included in the system. For example, should the user wish to include a very viscous liquid in the applicator, a base plate 42 having self-sealing valves 20 configured to work with such a liquid may be attached, e.g., a base plate 42 having valves 20 with larger slits at the bottom end 21 thereof. Alternatively, should the user wish to apply a medication with a low viscosity, such as an antiseptic, a base plate 42 having small slit valves or jet valves may be included. Accordingly, the unique three-part configuration of such an applicator device allows the selection not only of the liquid material and buffing element, but also of the best means to dispense the liquid material by selection of a base plate having a valve matched to the type of liquid material.

The cartridge 60 may be designed to be disposable or refillable. For example, the cartridge 60 may comprise a ZIPLOC style closure along a top perimeter that may be opened to allow easy refilling of the pouch with a liquid. This ZIPLOC style closure may then be closed to seal the cartridge 60. Alternately, the cartridge 60 may comprise a spout and cap that may allow refilling with a liquid material.

Figure 10:
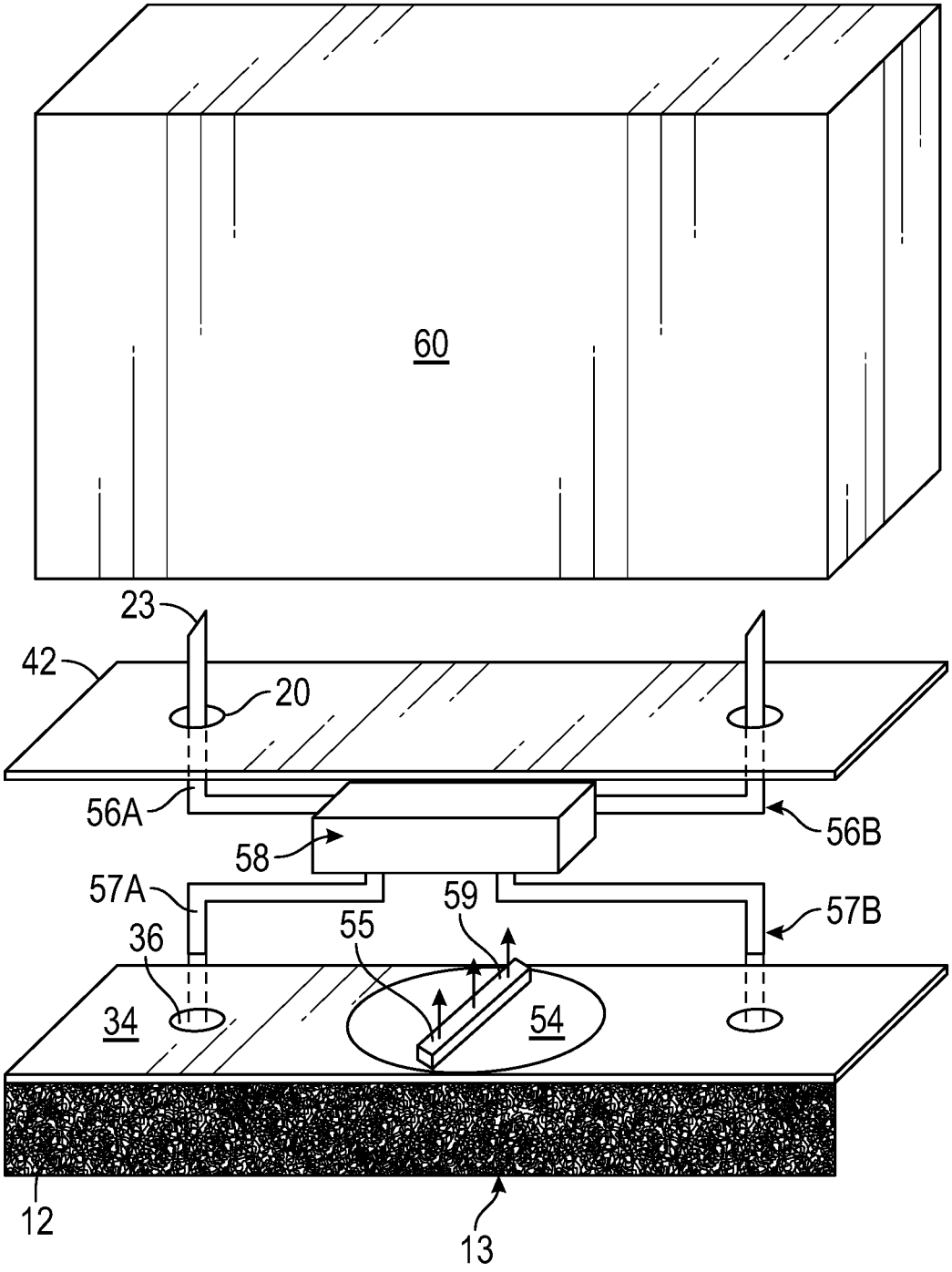
FIG. 10 illustrates a perspective view of an exemplary applicator device configured for use with a liquid material according to certain aspects of the presently disclosed embodiments.

Another exemplary configuration of the applicator device 1008 is illustrated in FIG. 10, wherein the housing is omitted for clarity and a cartridge 60 is shown. The buffing element 12 may include at least one liquid material port (36; two are shown in the figure) that allows passage of the liquid material from corresponding fluid lines (57*a*, 57*b*) to an exterior or outward facing or bottom surface 13 of the buffing element. The buffing element 12 may also include a trigger element, such as a rigid button or bar 55, that may accept an applied pressure (e.g., pressure from compressing the buffing element during use of the applicator device). The applied pressure moves the trigger element in a direction (arrows 59) toward a top surface of the applicator device where it applies a comparable compression force on a pressure chamber 58.

As shown in FIG. 10, the pressure chamber 58 may be a separate component of the applicator device, generally positioned below the housing and/or base plate 42. Alternatively, the pressure chamber 58 may be integrated with or formed as part of a bottom surface of the base plate 42. Likewise, the trigger element may be a separate element positioned adjacent to the top surface 34 of the buffing element 12 or may be formed as an integral part of the buffing element. Alternatively, rather than a trigger element that comprises a rigid button or bar 55, the trigger element may be formed as a compressible portion 54 of the buffing element. As such, an applied pressure on the bottom surface 13 of the buffing element, such as during use of the applicator device, may be transmitted from the compressible portion 54 to the pressure chamber 58.

Compression of the pressure chamber 58 forces liquid material contained therein to exit from the fluid lines (57*a*, 57*b*) to the buffing element 12. The fluid lines (57*a*, 57*b*) may include self-sealing valves that provide fluid flow in one direction only, such as from an interior of the pressure chamber 58 to the buffing element 12. Exemplary self-sealing valve includes at least slit valves, duckbill valves, umbrella valves, jet valves, and the like. Once the pressure is relieved from the pressure chamber 58, the one-way valves will not allow air or fluid to be pulled back into the pressure chamber through the fluid lines (57*a*, 57*b*), and thus a vacuum will be formed in the pressure chamber 58. This vacuum may then pull liquid material through at least one valve 20 in fluid communication with the liquid material in the cartridge 60, and associated fluid line(s) (56*a*, 56*b*) to refill the pressure chamber. As mentioned hereinabove, the valves 20 may be self-sealing valves that provide fluid flow in one direction only, such as from an interior of the cartridge 60 to the pressure chamber 58. Thus, once the pressure chamber 58 is refilled, the liquid material will not flow back into the cartridge 60 through fluid line(s) (56*a*, 56*b*), such as when an applied pressure is exerted on the trigger element (i.e., the liquid material in the pressure chamber 58 may only exit from the pressure chamber to the buffing element 12 through fluid line(s) 57*a*, 57*b*).

While the applicator device 1008 is shown in FIG. 10 to include both a trigger element (54 or 55) and a pressure chamber 58, configurations comprising only a trigger element (54 or 55) are within the scope of the present disclosure. That is, the trigger element (54 or 55) may be designed to occupy a position adjacent the buffing element 12, but in communication with the cartridge 60, such that pressure exerted on the buffing element may compress the trigger element (54 or 55), and in turn compress the cartridge 60. Such a configuration may be achieved, for example, in configurations that omit the base plate 42, or in configurations where the base plate 42 comprises an opening that allows communication of an applied pressure on the trigger element to be communicated to the cartridge 60 (i.e., opening in the center region of the base plate 42). Pressure on the cartridge 60 may open the valves 20 and allow liquid material to flow from the cartridge 60 to one or more fluid lines that provide fluid exit of the fluid material at the buffing element (such as at the liquid material ports 36).

In certain other arrangements of the applicator device 1008, a pump may be included to provide flow of the liquid material from the housing 14 or cartridge 60. The pump may be positioned in the housing 14 or may be included as part of the base plate 42. The pump may be mechanical or electrical and may be sealed from contact with the liquid or may be in fluid communication with the liquid. As such, depressing a button, such as on the housing 14, may activate the pump to provide a flow of the liquid material, either as a steady stream for the duration of the button activation or in a metered amount with each button activation.

As detailed herein, the pump can operate mechanically, without the use of electricity, such as by activation of a button (e.g., pumping the button to "pump" the liquid material). Alternatively, the system may be powered when an electric pump is included, such as by disposable or rechargeable batteries, and may be configured to include specific control logic implemented in software or hardware or a combination of both. For example, particular arrangements can be implemented by using application specific integrated circuits or programmed logic circuits. Such software/circuits may indicate a battery power level, a liquid material level, a type of liquid material included in the system, an amount or rate of liquid material to be dispensed, etc.

Figure 11:
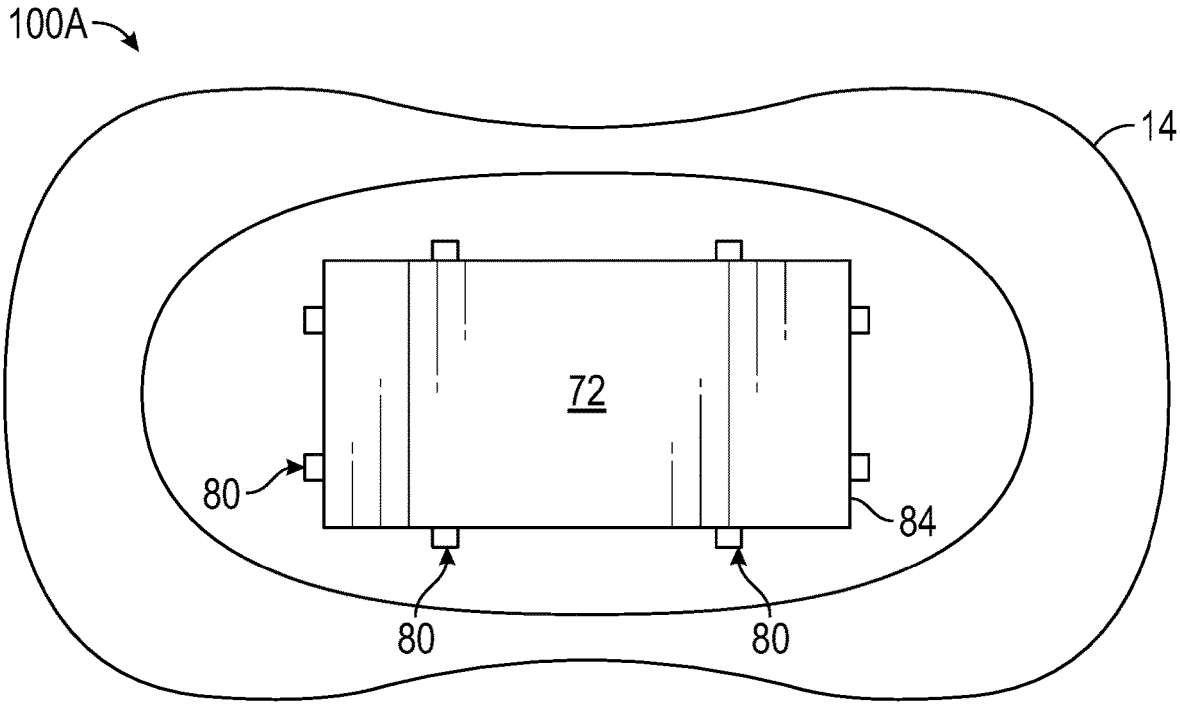
FIG. 11 illustrates a top view of an exemplary applicator device configured for use with a solid material according to certain aspects of the presently disclosed embodiments.
Figure 12:
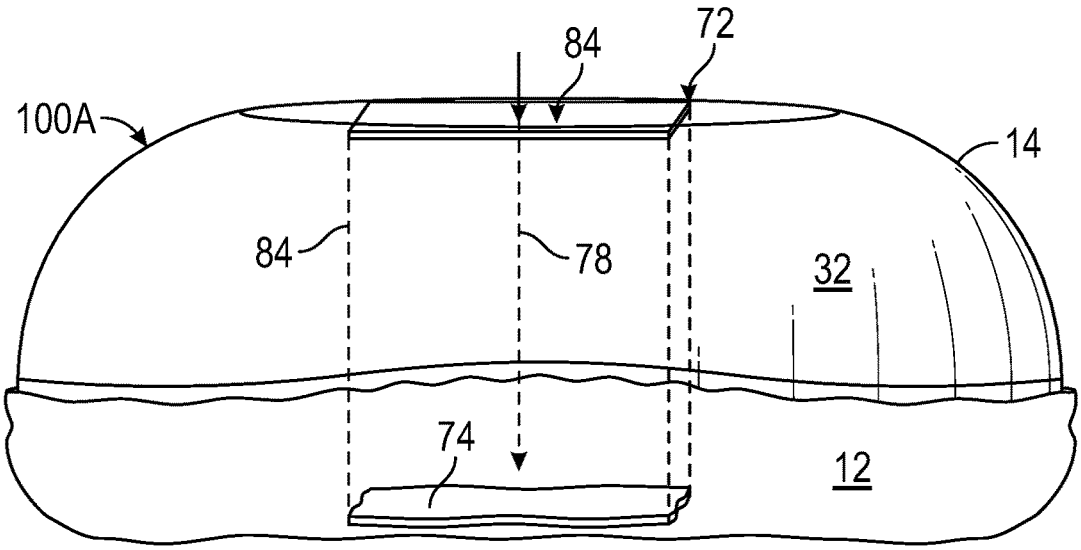
FIG. 12 illustrates a side view of the applicator device of FIG. 11, wherein a position of a receiving cavity for a solid material cartridge is shown.

An applicator device 100A configured to dispense a solid material is shown in FIGS. 11 and 12. The applicator device 100A generally comprises a housing 14 having an inner receiving cavity 84 configured to accept a solid material through an upper opening 72. The housing 14 also includes an outer surface 32, a portion of which is configured to be grasped by a user's hand, e.g., as a grip or handle. The device 100A further comprises a buffing element 12 attached to a bottom of the housing 14. The solid material may be accessible for application to a surface through a bottom opening 74 in the buffing element 12.

The buffing element 12 may be releasably attachable to the housing 14 as described hereinabove with respect to the applicator device 1008. Exemplary attachment means for the buffing element to the device include any one or more of a magnet, hook and loop closure, latch, or snap fit fastener (snap attachment).

Figure 13:
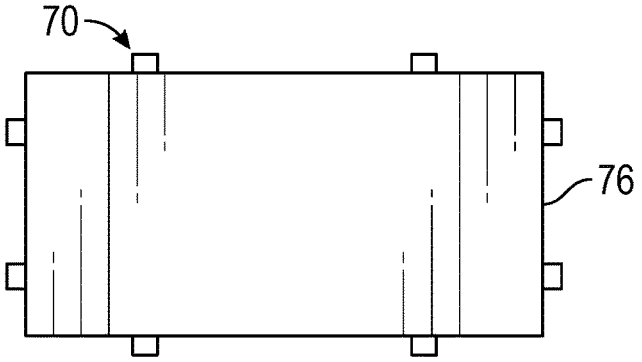
FIGS. 13 and 14 illustrate top view and side perspective views, respectively, of a solid material cartridge for use in an applicator device configured for use with a solid material.

The inner receiving cavity 84 may include one or more grooves 80 sized and positioned to accept one or more matched tongues 70 on a solid material. The solid material may include a plurality of tongues 70 (see FIG. 13) positioned about an outer circumference thereof. The tongues 70 may be individual elements having a longitudinal axis, wherein each element may be molded to the solid material with the longitudinal axis extending in the direction of arrow 78. Alternatively, the tongues may be part of a cartridge 76 having sides on which the tongues 70 are disposed, as shown in FIG. 13. The cartridge 76 may include solid sides or may include a netting or other connection elements between the various tongues 70. Moreover, the tongues 70 may be included as individual elements on all or some of the sides of the solid material 10, or on all or some of the sides of the cartridge 76, such as only on two opposing sides of a cartridge configured with four sides (see FIG. 14).

Figure 14:
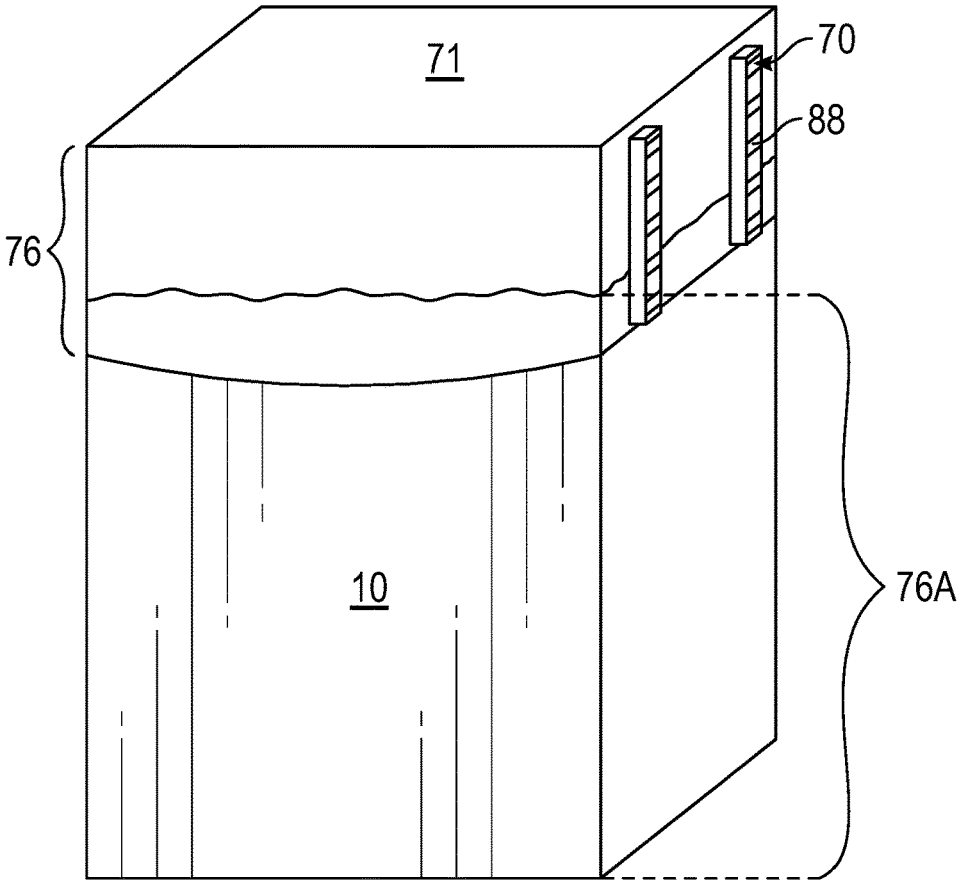

With specific reference to FIG. 14, the cartridge 76 is shown to be molded to a top region of a solid material 10, wherein a lower end 76*a* of the solid material 10 is outside of the cartridge 76. Each side of the cartridge 76 may include one or more tongue elements 70. A top end of the cartridge 76 may include a solid surface 71 or wall or may remain open so that the solid material is exposed. In the case of individual tongue 70 elements, it is considered that they would also not extend a full length of the solid material.

The individual tongue 70 elements or the cartridge 76 (referred to collectively as attachment elements) may be molded or connected to the solid material 10 after it is formed or may be molded or connected to the solid material 10 during production thereof. For example, in the case of a solid soap material, the attachment elements may be positioned in a mold used to form the soap, wherein the soap is poured into the mold in a heated liquid state and cools to form the solid material 10 having the attachment elements positioned on an outer perimeter thereof.

Each of the tongue 70 elements may include teeth 88 configured to interact with teeth 86 on the grooves 80 of the inner receiving cavity 84. The teeth may provide for movement of the solid material in one direction only, such as the direction of the arrow 78 shown in FIG. 12. In this way, the solid material may be positioned within the applicator device 100A so that it remains positioned within the cavity, e.g., does not "fall out" from an open top position, and may be advanced downward toward the buffing element 12 when the bottom portion is consumed during use.

Figure 18A:
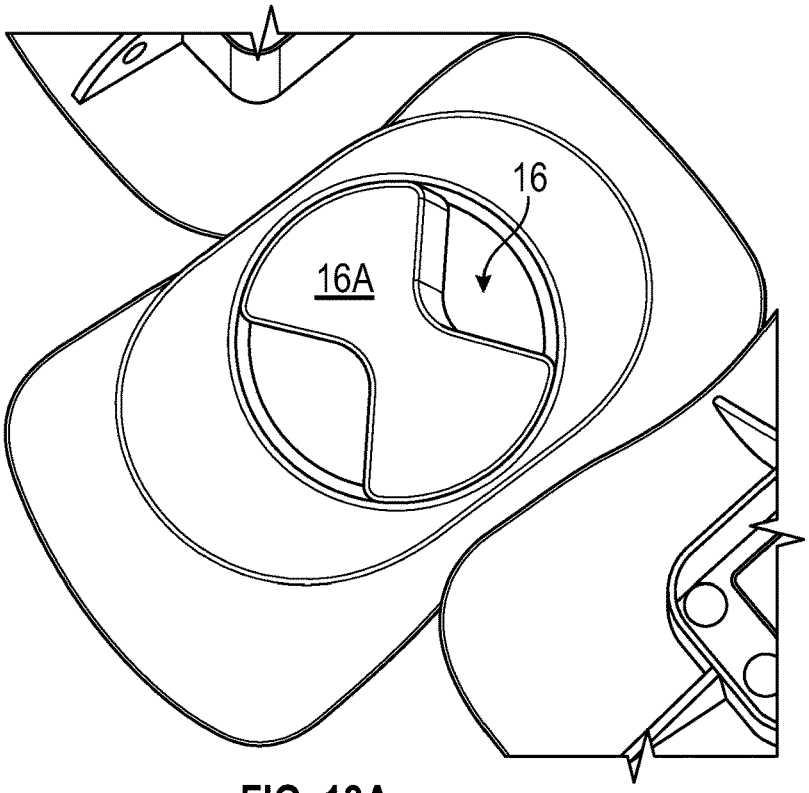
FIGS. 18A and 18B illustrate perspective views of a top side and bottom side, respectively, of a cover for an applicator device according to certain aspects of the presently disclosed embodiments.
Figure 18B:
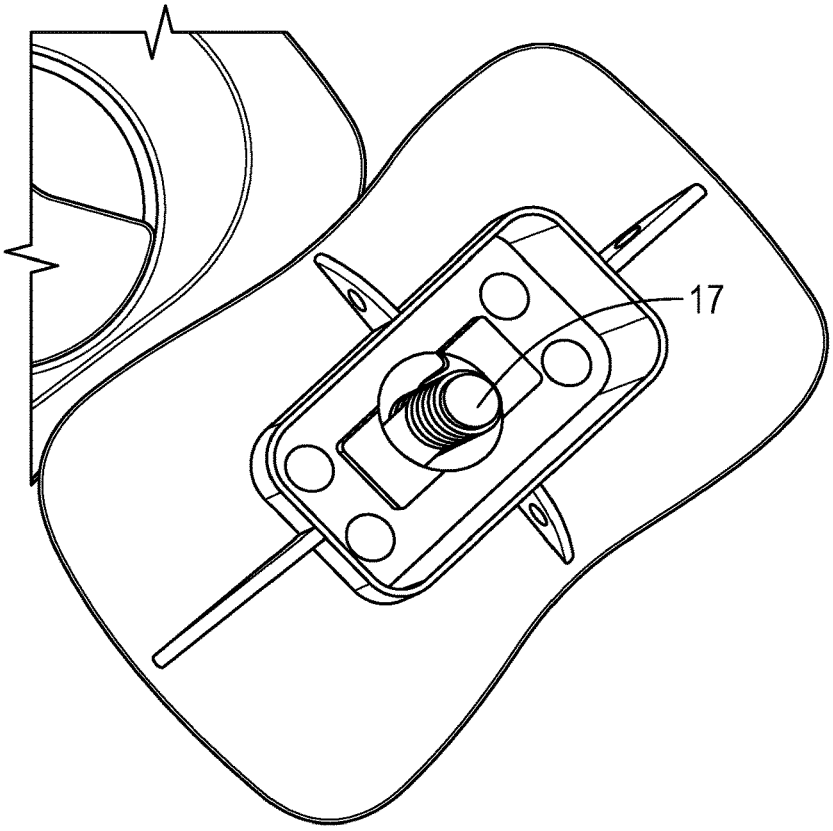

A user may manually push the solid material downward to expose an additional amount of the material adjacent the buffing element, or the applicator device may include a cap or cover 16 as shown in FIG. 1. According to certain arrangements, the cover 16 may be included to enclose the receiving cavity 84. With specific reference to FIGS. 18A and 18B, the cover 16 may include an outer portion 16*a* on an outward facing side, as shown in FIG. 18A, and an inner portion 17 on an inward facing side, as shown in FIG. 18B. The inner portion and the outer portion may be moveably attached to each other such that movement therebetween moves the inner portion within in the receiving cavity. In the example shown in FIGS. 18A and 18B, the outer portion 16*a* may comprise a dial, rotation of which may cause the inner portion, shown as comprising at least a screw, to move downward within the inner receiving cavity 84, thus pushing a solid material or cartridge received therein downward along arrow 78 (FIG. 16) toward the bottom side thereof.

Figure 15:
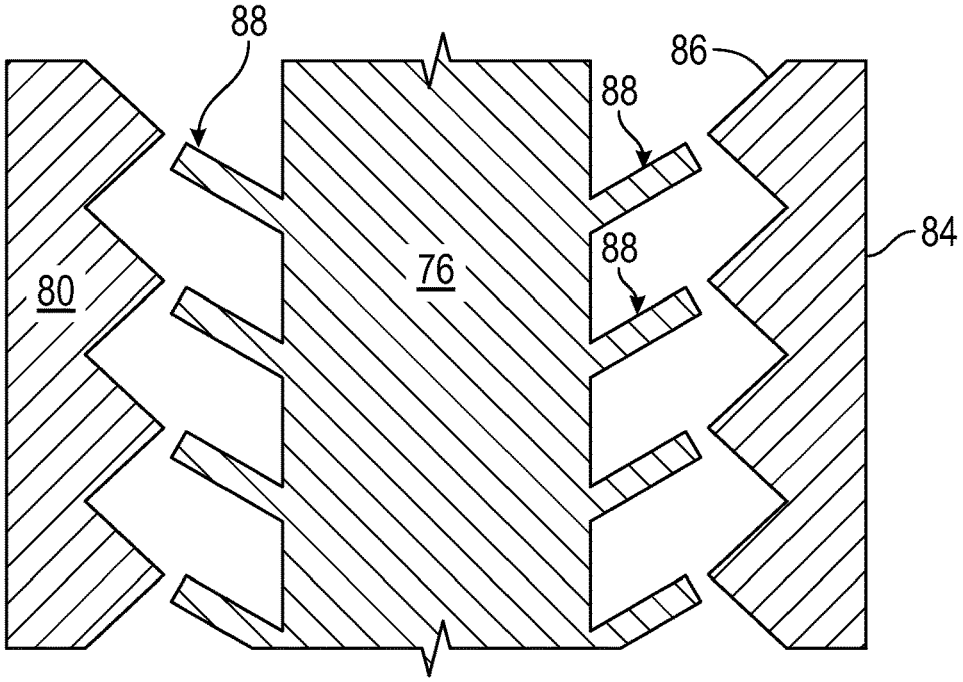
FIGS. 15 and 16 illustrate close-up cross-sectional views of a tongue and groove connection mechanism for a solid material cartridge received within the receiving cavity of the device, shown in the disengaged and engaged positions, respectively.
Figure 16:
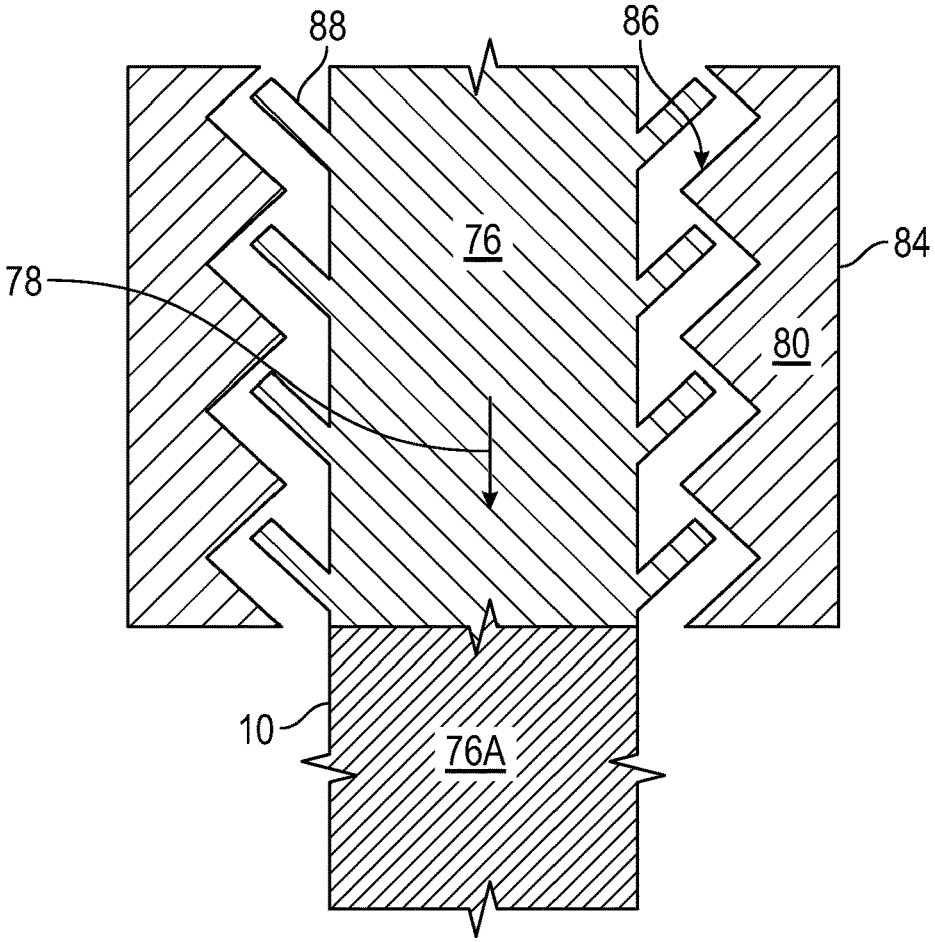

With reference to FIGS. 15 and 16, a specific configuration of the teeth 86 on the grooves 80 of the inner receiving cavity 84 and the teeth 88 on the tongues 70 of the cartridge 76 is shown in cross-section. The tongue 70 elements generally include flexible teeth 88 that may bend inward when pushed into the inner receiving cavity, i.e., as the solid material 10 is pushed into the inner receiving cavity 84 from a top opening thereof and past the non-flexible teeth 86 of the grooves 80. As shown in FIG. 16, should a user try to push the solid material 10 in an opposite direction, such as from the bottom opening 74 of the device, the flexible teeth 88 would expand and catch the teeth 86 within the grooves 80 on the inner receiving cavity 84. Since these teeth 86 are not flexible, the cartridge 76 would not be able to advance upward (direction opposite from arrow 78). If the user wanted to reposition the solid material upward in the applicator device, they would need to advance the solid material in the direction of arrow 78 to a point outside of the applicator device and reinsert the solid material back into the inner receiving cavity 84 from an open top side (opening 72) thereof.

Figure 17:
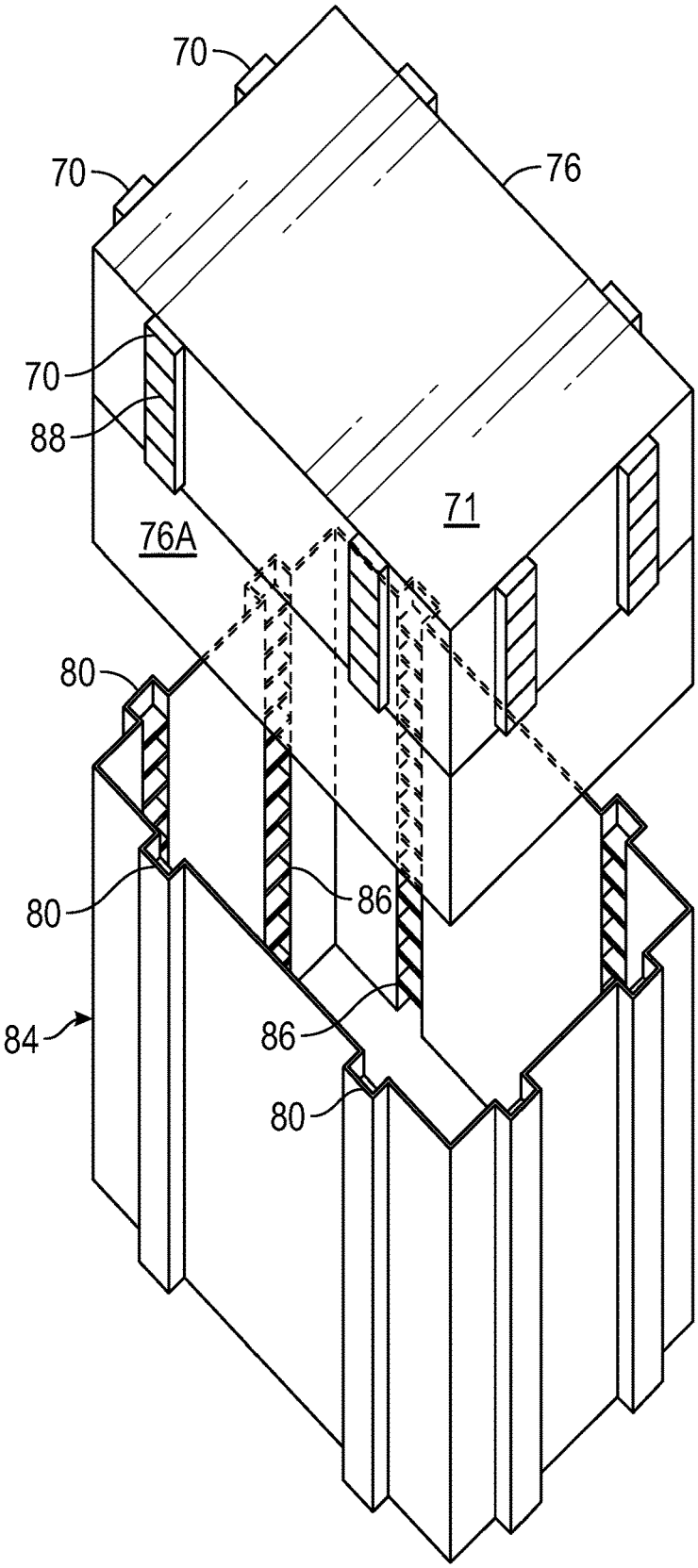
FIG. 17 illustrates a side perspective view of a solid material cartridge being received within a receiving cavity according to certain aspects of the presently disclosed embodiments.

An exemplary arrangement of tongues 70 positioned on sides of a solid material or cartridge 76 and an inner receiving cavity 84 comprising matching grooves 80 is shown in FIG. 17. Note that the grooves 80 may extend a full length of the housing 14 of the applicator device 100A. Moreover, the inner receiving cavity 84 may extend below the housing 14 into a central cavity on the buffing element 12 so that the tongues 70 may advance a full usable portion of the solid material within the applicator device.

According to certain aspects, as the solid material is consumed through application on a surface, the user may advance the solid material further down in the applicator device, i.e., toward the opening 74 of the buffing element 12. In general, only a small portion of the solid material may be covered by the cartridge 76 or the tongue 70 elements, i.e., little to none of the solid material is unusable. In some cases, when individual tongue 70 elements are included on the solid material, when lower portions thereof become exposed through use of the solid material, the exposed portions of the tongue 70 elements may break off or be cut off to provide greater usage of the solid material.

Figure 19A:
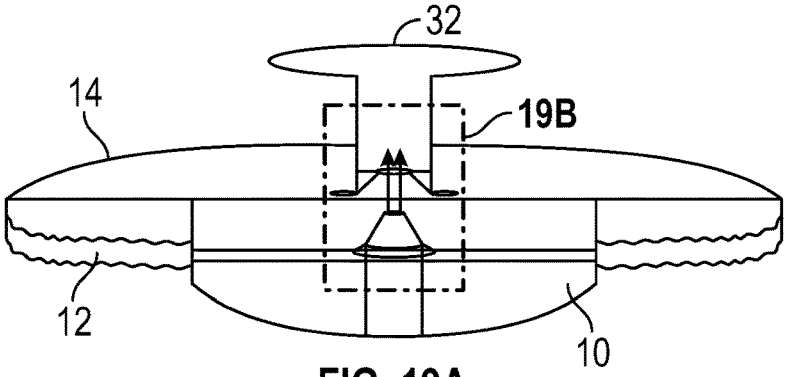
FIG. 19A illustrates a cross-sectional view of an exemplary applicator device configured for use with a solid material according to certain aspects of the presently disclosed embodiments.

Another exemplary configuration of the applicator device 100A is illustrated in FIG. 19A. The applicator device may generally comprise a housing 14 having an outer surface 32 configured as a grip and a buffing element positioned 12 on a bottom surface. The applicator device may include an inner cavity configured to accept a solid material 10. As shown in FIG. 19C, the solid material may be positionable within the inner cavity through an opening 94 in the buffing element 12.

The buffing element 12 may be releasably attachable to a bottom surface of the housing 14, or may be permanently affixed to, or formed as an integral part of, the housing. The housing and buffing element may be formed of any of the materials described herein. In certain preferred configurations, the applicator device shown in FIG. 19A may be formed of a polymeric material, such as an elastomeric polymer (e.g., silicone).

Figure 19B:
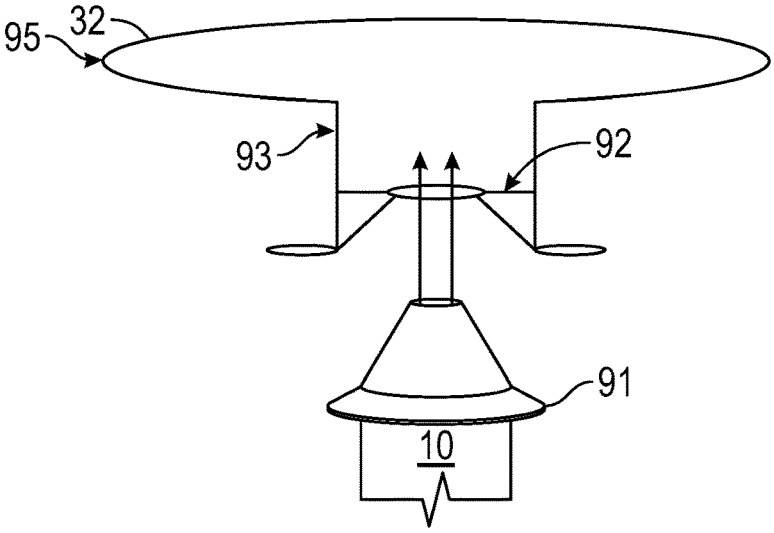
FIG. 19B illustrates a close-up cross-sectional view of an attachment element for a solid material in the exemplary applicator device shown in FIG. 19A.
Figure 19C:
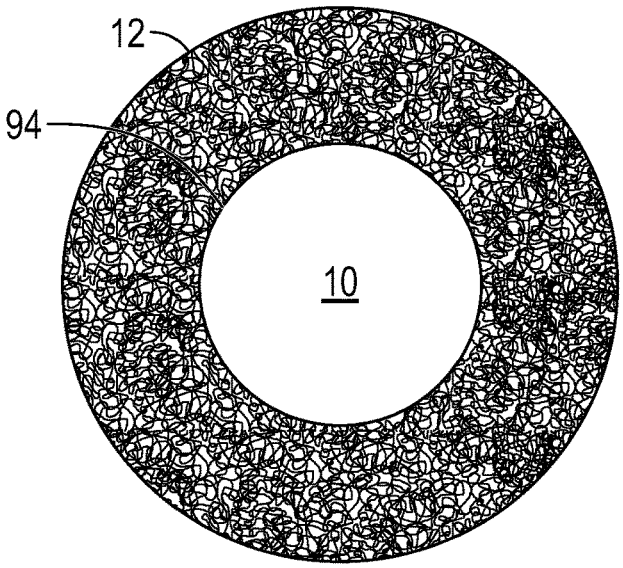
FIG. 19C illustrates a bottom surface of the exemplary applicator device shown in FIG. 19A.

With specific reference to FIG. 19B, a close-up cross-sectional view of the grip is illustrated. The grip may include a top handle portion 95 connected to the upper exterior surface of the housing 14 by a neck region 93. The neck region 93 generally has an outer circumferential diameter that is smaller than an outer circumferential diameter of the handle 95. The neck region 93 may extend the inner cavity of the housing and may include an inner surface comprising a circumferential element 92, such as a ledge or protrusion, configured to engage with a retention element 91 of the solid material 10. The retention element 91 may be formed on the solid material 10 during production thereof. For example, in the case of a solid soap material, the retention element 91 may be positioned in a mold used to form the soap, wherein the soap is poured into the mold in a heated liquid state and cools to form the solid material 10 having the retention element 91 positioned on an upper surface thereof.

The solid material 10 is illustrated in FIGS. 19A and 19B to be secured within the housing 14 in a single position, i.e., the solid material 10 is not repositionable within the housing to extend use of the device after an amount of the solid material has been consumed. As such, this simpler version of the applicator device for solid materials may be configured for temporary applications, i.e., disposable after only one or a few uses. Exemplary uses could include replacing small bars of soap commonly found in hotel showers and spas. However, while shown as including a static connection between the solid material and the housing (engagement between the circumferential element 92 of the neck region 93 and the retention element 91 molded to the solid material 10), any of the connection means described herein are possible and within the scope of the present embodiments. For example, the handle 95 may be designed substantially as described hereinabove with reference to the cover (16, 17), wherein the handle may be turnable to extend an inner portion (e.g., screw) that may push the solid material down toward the buffing element. In such a case, the circumferential element 92 may be configured as a portion of a screw or extension element on an inner cavity of the handle 95.

While specific embodiments of the disclosure have been described in detail, it should be appreciated by those skilled in the art that various modifications and alternations and applications could be developed in light of the overall teachings of the disclosure. Accordingly, the particular arrangements, systems, apparatuses, and methods disclosed are meant to be illustrative only and not limiting as to the scope of the invention.

LIST OF REFERENCE NUMBERS

10 solid material
12 buffing element of applicator device
13 outward facing surface of the buffing element 12
14 housing of applicator device
14*a* housing with connection groove
14*b* housing with connection lip
16 cover for solid material
16*a* outer portion of the cover 16
17 inner portion of the cover 16
20 valves for liquid material
21 top surface/opening of valve 20
23 puncture end of valve 20
30 push button(s) to create air pressure in sealed cavity of housing 14
31 direction of connection of the top and bottom portions of the device
32 hand grip portion of the housing 14
34 top connection surface of the buffing element 12
36 liquid material port in the buffing element 12
38 connection groove or lip
38*a* connection groove
38*b* connection lip
40*a* connection arm of the base plate 42 for connection to the connection groove 38*a*
40*b* connection arm of the base plate 42 for connection to the connection lip 38*b*
42 base plate for attachment to housing 14
44 exit direction of the liquid material
50 inner cavity of housing 14
52 top surface of applicator device 1006
54 compressible portion of the buffing element
55 bar that triggers release of liquid material from the
56*a,b* fluid lines providing flow of liquid material from the cartridges to the pressure chamber
57*a,b* fluid lines providing flow of liquid material from the pressure chamber to the buffing element
58 pressure chamber
59 direction of movement of the bar 55 or compressible portion 54 when pressure is applied to the buffing element
60 liquid material reservoir or cartridge
61 top portion of cartridge 60
62 housing attachment edge of cartridge 60
64 opening or puncture points on the liquid material reservoir
64*a* openings in the housing or cartridge
70 tongue with teeth 88 on solid material cartridge 76
71 top surface of solid material cartridge 76
72 upper opening of device configured to accept solid material cartridge 76
74 bottom opening for dispensing solid material 10
76 solid material cartridge or holder
76*a* portion of solid material 10 extending from the cartridge 76
78 direction of travel of solid material cartridge 76
80 groove with inner teeth 86 on the receiving cavity 84
84 receiving cavity for solid material cartridge 76
86 teeth on the groove 80 of the receiving cavity 84
88 teeth on tongue 70 of solid material cartridge 76
91 retention element engageable with the circumferential element 92
92 circumferential element of the neck 93
93 neck region of the grip
94 opening in the buffing element 12 that accepts the solid material 10
95 handle portion of the grip
100A applicator device configured for solid materials
1008 applicator device configured for liquid material

The invention claimed is:

1. A device for dispensing a liquid material, the device comprising:

a housing having an interior side, an exterior side, and a circumferential edge, wherein the interior side defines an inner cavity configured to accept an replaceable cartridge containing the liquid material, wherein at least a portion of the exterior side of the housing is flexible or includes a compressible element, and wherein at least a portion of the exterior side is configured as a grip;

a buffing element; and at least one valve comprising a first end extending within the cartridge and a second end located at the buffing element, wherein the at least one valve is configured to dispense liquid material from the cartridge, through the at least one valve from the first end to the second end and to the buffing element, wherein the buffing element is releasably attachable to the housing, and wherein the at least one valve is a self-sealing valve, and configured such that an applied pressure on the at least the flexible portion of the housing or the compressible element forces the interior side of the housing to impinge on and compress the cartridge, wherein the cartridge compression forces the liquid material from the housing to the buffing element.

2. The device of claim 1, wherein the at least the flexible portion of the housing comprises a button, a pliable material portion, or both that are configured to accept the applied pressure to compress the housing and the cartridge and force the liquid material through the at least one valve to the buffing element.

3. The device of claim 2, wherein the housing is configured to form an airtight seal with the cartridge when the cartridge is received in the inner cavity of the housing so that the applied pressure is communicated to the cartridge to force the liquid material through the at least one valve.

4. The device of claim 3, wherein the airtight seal comprises a snap attachment in either of a groove or ledge on the circumferential edge of the housing.

5. The device of claim 1, wherein the buffing element comprises at least one liquid material port configured to allow passage of the liquid material to a bottom side of the buffing element, and wherein the buffing element is configured to releasably snap into a groove or ledge around the circumferential edge of the housing.

6. The device of claim 1, comprising a base plate having a top side, a bottom side, and a circumferential edge substantially coincident with the circumferential edge of the housing, wherein the bottom side of the base plate is configured to releasably attach to the buffing element and the top side of the base plate is configured to releasably attach to the circumferential edge of the housing, wherein the at least one valve is positioned in the base plate.

7. The device of claim 6, wherein the buffing element is configured to releasably attach to the base plate via one or more of a magnet, hook and loop closure, latch, or snap fastener, and the base plate is configured to releasably snap into a groove or ledge on the circumferential edge of the housing.

8. The device of claim 1, wherein the at least one self-sealing valve comprises a distal end facing the housing and is configured to pierce the cartridge contained therein to provide a fluid passage for the liquid material to the buffing element.

9. The device of claim 1, wherein the at least one valve is a slit valve.

10. The device of claim 1, wherein the buffing element comprises a textile, a spongy material, a brush, rounded protrusions, or any combination thereof.

11. The device of claim 1, wherein the cartridge comprises a connector for mating with the at least one valve.

12. The device of claim 1, wherein the cartridge comprises the at least one valve and a chamber.

13. The device of claim 1, wherein at least a portion of the cartridge is pliable.

14. The device of claim 1, further comprising a base plate, wherein the base plate is positioned adjacent to the cartridge, and wherein the buffing element is removably coupled to the base plate.

15. The device of claim 1, wherein the compressible element comprises a button coupled to the housing, wherein the button is configured to compress and force the contents of the cartridge through the at least one valve.

16. The device of claim 1, wherein upon compression of the cartridge the liquid material flows directly from the cartridge to the buffing element.

* * * * *